US005392968A

United States Patent [19]

Dark

[11] Patent Number: 5,392,968

[45] Date of Patent: Feb. 28, 1995

[54] DISPENSING CLOSURE AND METHOD

[76] Inventor: Richard C. G. Dark, 8553 Red Hill Country Club Dr., Rancho Cucamonga, Calif. 91730

[21] Appl. No.: 78,006

[22] Filed: Jun. 14, 1993

[51] Int. Cl.[6] ..... B65D 47/06

[52] U.S. Cl. ..... 222/529; 222/528; 222/530; 222/536; 222/534

[58] Field of Search ..... 222/527, 528, 529, 530, 222/531, 532, 534, 536

[56] References Cited

U.S. PATENT DOCUMENTS

| | | | |
|---|---|---|---|
| 2,893,611 | 7/1959 | Akers | 222/536 |
| 2,893,612 | 7/1959 | Akers | 222/536 |
| 3,045,880 | 7/1962 | Akers | 222/536 |
| 3,111,245 | 11/1963 | Libit et al. | 222/534 |
| 3,181,743 | 5/1965 | Libit et al. | 222/528 |
| 3,323,694 | 6/1967 | Stevens | 222/530 |
| 3,718,238 | 2/1973 | Hazard et al. | 222/536 |
| 3,907,179 | 9/1975 | Pehr et al. | 222/513 |
| 4,440,327 | 4/1984 | Dark | 222/534 X |
| 4,505,312 | 3/1985 | Lardner et al. | 222/528 |
| 4,732,303 | 3/1988 | Wang | 222/534 X |
| 4,860,934 | 8/1989 | Komischke | 222/534 |

FOREIGN PATENT DOCUMENTS

| | | | |
|---|---|---|---|
| 48208 | 8/1982 | Germany | 222/528 |
| 8602674.7 | 10/1987 | Germany . | |
| 41111895 | 10/1992 | Germany . | |

*Primary Examiner*—Andres Kashnikow
*Assistant Examiner*—Kenneth Bomberg
*Attorney, Agent, or Firm*—Ronald M. Goldman

[57] ABSTRACT

A resealable plastic closure formed of one piece of plastic material includes a swivelable diaphragm to allow a hinged spout to pivot between an upright dispensing position and a down closed position. To permit easier operation in closures containing diaphragms in small sizes, the diaphragm is divided by a crease, hinging the two section, and one diaphragm section is invertible and the other diaphragm section is pliable, deformable. Improved side latches for the spout are provided by flexible latch member supporting wall that may flex into an adjacent cavity on the underside of the closure base. The fabrication of those side latches is enhanced in a process that withdraws one tool to create a void behind the latch member supporting walls so that the other tool, which forms the latch member, may be withdrawn without damaging the member by forcing the walls to flex laterally as the second tool is withdrawn. In one such resealable closure that is particularly adapted for drinking cup application a novel spout seal of cylindrical tubular section provides the sealing function by collapsing the cylindrical wall in response to the spout being placed in the closed position.

27 Claims, 4 Drawing Sheets

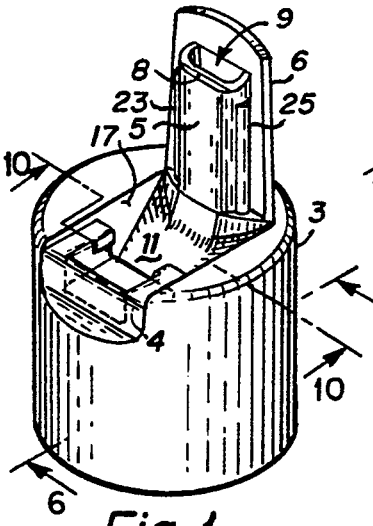
Fig_1
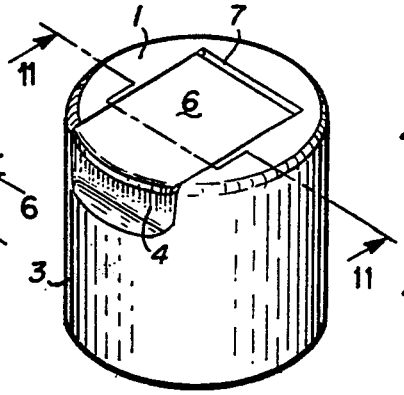
Fig_2
Fig_3
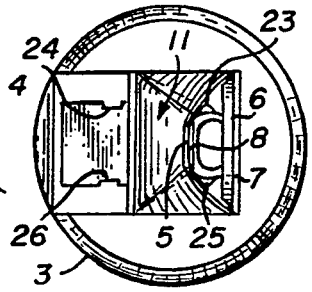
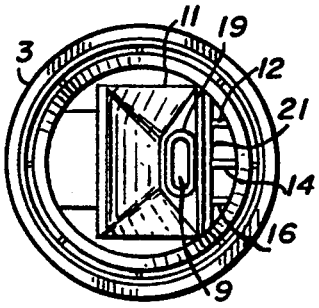
Fig_4
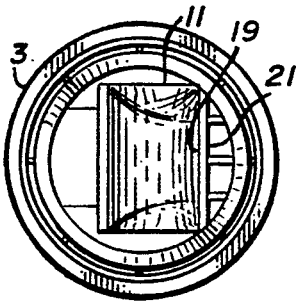
Fig_5
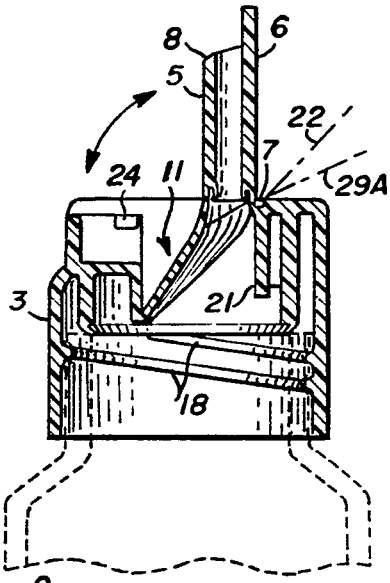
Fig_6
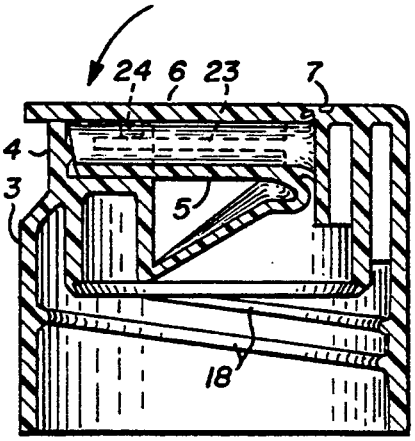
Fig_7
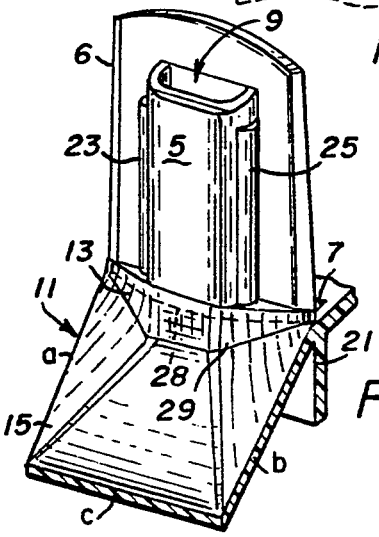
Fig_8

Fig_9A
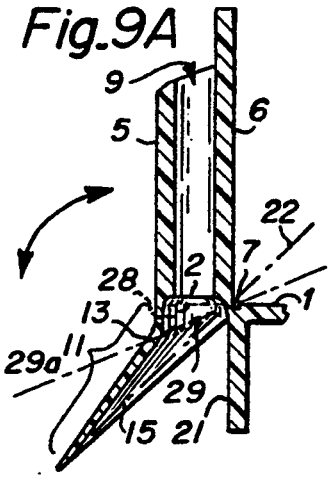
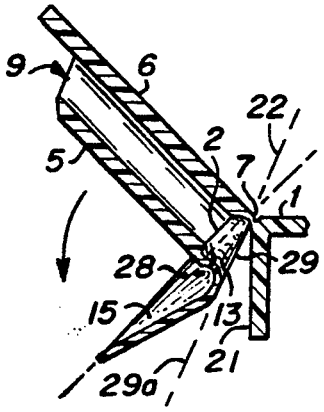
Fig_9B
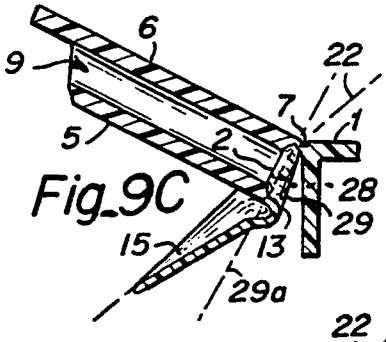
Fig_9C
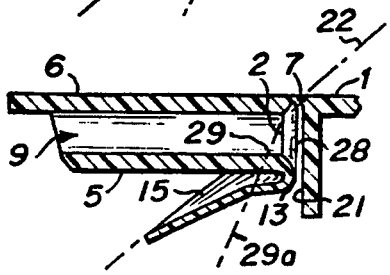
Fig_9D
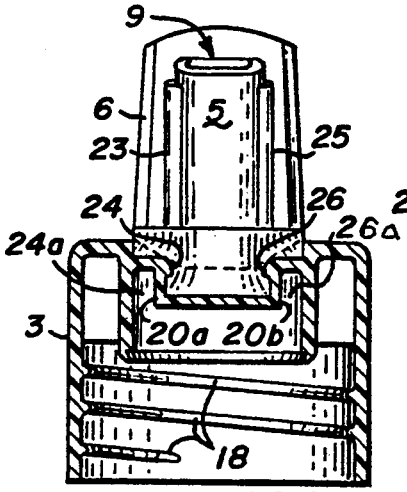
Fig_10A
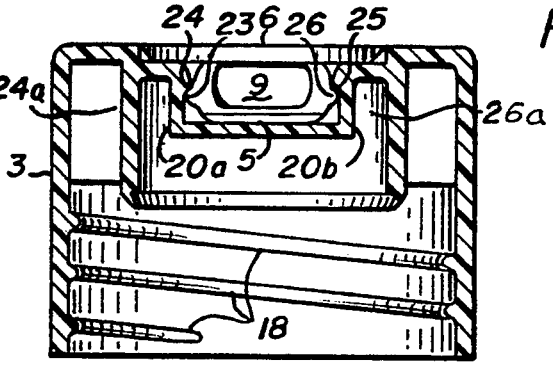
Fig_10B
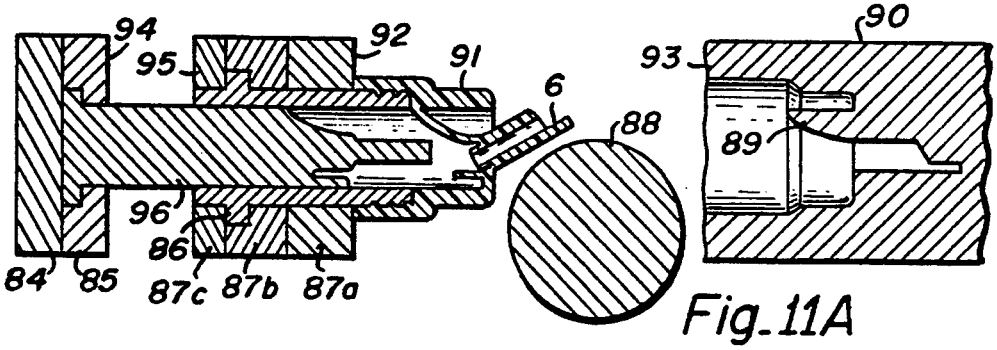
Fig_11A
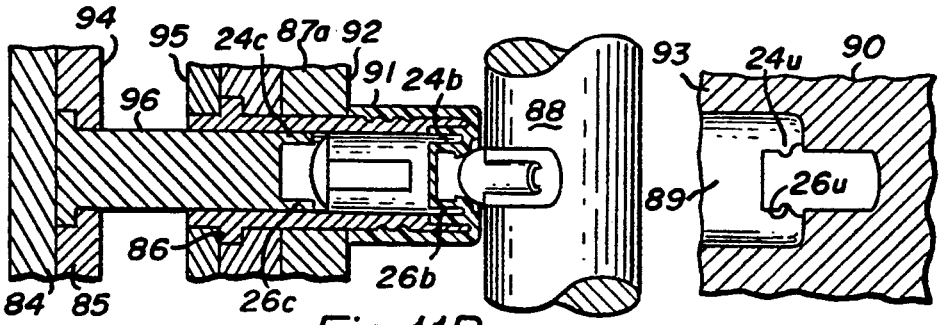
Fig_11B

DISPENSING CLOSURE AND METHOD

FIELD OF THE INVENTION

This invention relates to improved resealable dispensing closure members, to the method of manufacture of the closure member and, more particularly, to improvements that enhance the industrial application and versatility of one piece injection molded resealable dispensing closure members.

BACKGROUND

Resealable plastic dispensing closure members or, simply, closures are principally applied to cap or close containers for beverages, liquid soaps and other liquid and fluent material that one may purchase at the supermarket for household use or otherwise. Fastened or otherwise attached to a bottle, vessel, or container, as variously termed, the closure allows the container to be opened, a portion of the contents to be poured out, and then resealed for later occasions on which to dispense remaining portions. Such closures also find application in different fields, as example, as a cap to a drinking container, such as a baby training cup or a cyclist's water bottle, wherein to dispense the beverage the closure's dispensing spout is inserted directly into the users mouth.

In U.S. Pat. No. 4,440,327 to Dark, the present inventor, granted Apr. 3, 1984, entitled "Fluid Dispensing Closure with Integral Valve", "the Dark patent", one closure is described that contains a swivelable spout and an invertible elastic membrane or diaphragm with the entire closure being formed in one piece of plastic material by an injection molding process. The spout is hingedly connected to the closure base along one side of the spout's foot end or base, permitting pivotal movement of the spout between a dispensing position and a closed or sealed position. Another portion of that spout's bottom end is coupled to the diaphragm, while the remaining portion of the diaphragm's periphery is connected to the closure base. The diaphragm seals the front or dispensing end of the spout from the spout's bottom end located on the inner side of the closure. Fluid may thus pass from the closure only through the passage in the spout.

Swiveling the spout about its pivot thus also moves or swivels the invertible diaphragm. Swinging the spout from an upright dispensing position to a down closed position, a portion of the diaphragm is thus swung by the spout during which movement the diaphragm's shape changes from a generally convex shape, which is resiliently flexed or deformed as the diaphragm is carried through a bi-sector plane defining a dead center position, and is elastically restored to a relatively concave shape when the spout is in the closed position. The invertible diaphragm's convex shape provides a force tending to hold the spout in its dispensing position and the concave shape provides a force tending to hold the spout closed. With the spout in the closed position a resilient seal located at the bottom of the spout engages and seals to a seal surface on the closure base to seal the closure.

Effectively the invertible diaphragm pre-loaded the spout in each position, open or closed, in which the user set the spout. The preferred embodiment of that prior closure invention made full use of the pre-load feature by incorporating only the invertible characteristic in the diaphragm. Closure structures built in accordance with the teachings of the Dark patent established the viability of a one piece closure that could be flipped open and closed.

Such closure design proved versatile; closures could be fabricated in various sizes, both large and small. So effective was the invertible diaphragm principle that in small sized closures it was found that the spout was more difficult than desired to flip open. The size and shape of the diaphragm governed the effort required of the user to open and close the closure. During pivoting of the spout, the diaphragm is temporarily distorted in shape in order to pass through the bi-sector plane, dead center. The percentage of the diaphragm's length that must be temporarily deformed, thusly, depends on the shape of the diaphragm. The greater the percentage of distortion of the diaphragm that is required, the greater the effort required to flex it. As example, a long diaphragm with a shallow angle relative to the dead center bi-sector plane, the percentage deformation was 14%, whereas with a short diaphragm with a greater angle the percentage was 20%. All other physical characteristics being equal, the force that the user must exert to open the latter closure is greater.

One ready way to reduce the effort required to operate the closure is by using a softer and more pliable plastic material for its construction. While that may be an acceptable solution for many applications, so doing sometimes works against the total closure system. A closure of softer plastic while easier to flex, is also more easily distorted in the process of screwing the closure onto the associated bottle. Such distortion may cause the spout to come unlatched, resulting in leakage.

As hereinafter brought out, one aspect of the present invention addresses curing that difficulty without resort to substitution of a softer plastic material. With the invention stiffer plastics may be used with less likelihood of distortion and without requiring excessive force to operate the closure. An object of the present invention is to provide an improved diaphragm for the closure, one that is compact, but which, nonetheless retains the invertible diaphragm structure, and does not require as much force to raise the spout, thereby allowing the closure to be opened and closed more easily.

In a preferred form of the closure described in the Dark patent, a latch is provided to hold the spout closed. The front end of the spout could be latched against a sturdy wall of the closure base, creating an axially directed compressive force on the spout that served to further compress the seal at the bottom end of the spout, enhancing sealing action. With outward flared seals, such as those in the shape of a Belleville spring, compressive forces created within the container to which the closure is attached, such as may be caused by vaporization of confined fluids, serve to further tighten the seal.

In practical application it was also discovered that latching the spout at the front end as suggested in the Dark patent was not always effective. In those applications in which the particular closure was fitted to containers by screw threads molded onto the closures inner surface in which the closure is adapted to be screwed onto a threaded bottle opening, the front latch would sometimes release and allow leakage. The closure in that application is placed on a threaded bottle top and is then twisted by automatic assembly machinery to screw the closure fully into place until the closure could be turned no more. However, the turning force, sometimes was not released quickly enough, and was sometimes great enough to cause overtightening and temporary distortion of the closure. Overtightening of the plastic closure was found to temporarily distort its geometry, thereby causing the front latch to release. Since the bottle being capped was filled with liquid, with the spout unlatched some leakage could thereafter occur, an obviously undesirable consequence.

To cure that latching problem Komischke, in U.S. Pat. No. 4,860,934 granted Aug. 29, 1989, entitled, Closure for Receptacles, assigned to the Schmalbach-Lubeca AG company, a licensee, provides a pair of side latches to hold the spout in the closed position, one located on each side of the pivotally mounted dispensing spout.

In general each such side latch includes an upstanding elastic post or web located to the side of the spout containing a laterally extending protrusion or bar, as variously termed, and the adjacent side of the pivotable spout contains a latch rib or strip. The bar lies in the path of travel of the spout rib, wherein the web's bar and the rib inter-engage to thereby form a releasible latch. When the spout is pivoted from the upright dispensing position toward the closed position, the rib first encounters and abuts against the bar, requiring the user to exert a greater force on the spout and thereby force the upstanding web, through force exerted on the rigid latch bar, to temporarily bend, flex outwardly to the side, away from the spout, allowing the rib to be moved past the bar and the spout to attain its closed position. Due to its elasticity the web snaps back to its normal upright position with the bar overlying and in blocking contact with the corresponding rib on the spout in latching engagement, latching the spout in the closed position, and thereby prevents the spout from prematurely opening. All such latches are released by the user applying suitable force to uplift the spout. More exact details may be found in the Komischke patent. Such side latches are preferably used in conjunction with the front latch, such as disclosed in my prior patent, U.S. Pat. No. 4,440,327.

The twisting force used to screw the closure member onto the bottle as earlier described might sometimes cause one side latch to temporarily release, the other side latch, nonetheless, remained active and held. Hence the pivotable spout remains in the closed position and, upon removal of the twisting force, the one side latch restores to its position latching the spout, joining with the continuing latching function of the other side latch, as the temporarily deformed plastic closure elastically restores to its proper shape under the action of the stored elastic force. Though offering a solution to the described problem, as is evident from review of the Komischke patent, the tooling to manufacture the closure is more difficult and complex.

The latch mechanism illustrated in the Komischke patent can only be molded as an undercut in the stationary half of the mold. To make a mold capable of producing such undercut shape requires inclusion of retractable core pins in the stationary half of the mold. During molding those core pins must be retracted out of the mold cavity before the mold opens. In this manner the undercut portion can be laterally flexed out of its position in the cavity steel. More specifically, the upstanding wall on which the latch protrusion is molded is required to flex as the mold is moved, allowing the protrusion to exist the undercut in the mold in which the protrusion was formed. The upstanding wall can only flex, however, if there is a hollow area behind that wall. Such hollow area is formed by the retractable core pins in the stationary half of the mold. The pins are retracted before the mold opens, as previously described, vacating the necessary space to create the hollow area.

One approach heretofore taken by the present inventor to avoid expensive tooling containing supplementary moveable rods of the type needed for the side latch disclosed in Komischke was to carefully shape the geometry of the latch member bar and associated web so that the supporting web was tapered, wider at the bottom than at the top, and the protruding bar was also tapered. That allowed the protrusion to be resiliently bent over into the portion of the cavity in the tool vacated by the web portion as the tooling cavity was withdrawn. Though use of the foregoing method was generally successful, in many instances the protrusions were damaged in that process, resulting in a smaller than desired yield of acceptable closures in the manufacturing process and, hence, less favorable manufacturing costs. An additional object of the invention is to provide a new side latch design for the one piece closure that does not damage the latch during manufacture, achieving higher yields in the manufacturing process, and to the new method of manufacture.

The invention also provides a novel design for the structure of side latches in a one piece plastic closure member and an associated novel method of manufacture for those members. The invention permits manufacture of one piece closures containing side latches with better manufacturing yields and, hence, at lower manufacturing cost than heretofore; a decided practical advantage.

Closures are used to cap threaded bottles. With closures of type shown in the Dark patent, the diaphragm and the supporting structure may be designed to fit above the top of the bottle and/or may be designed to fit within the neck of the bottle. Often a particular closure design is achieved to obtain desired physical characteristics, a feel, for a particular spout and diaphragm, such as size and particular ease of operation, that heretofore could be achieved only if as a consequence the diaphragm was required to extend within the neck of the bottle. Ordinarily that should not pose an obstacle as one should ordinarily expect the inner diameter of the bottle to be specified to appropriate tolerance.

Unfortunately the bottle manufacturing industry allows a wide tolerance on the "I" dimension, the inside dimension of the bottle's neck, and many vary considerably in size. If the diaphragm were to be so large in size as to telescope down inside the neck of the bottle, it may not always fit and may interfere with the inside surface of the bottle's neck, an obviously undesirable situation.

The present invention addresses the need for a small size closure of the basic type disclosed in the Dark patent that is intended for application to screw type bottles in which the geometry is such that the closure's diaphragm and associated closure structure supporting such diaphragm does not descend into the bottles neck and yet the closure overall presents the desired feel of easy operation.

A related object is to provide a one piece plastic closure that uses a diaphragm that is shorter in length. An advantage to the shorter design is that it allows a dispensing cap to be designed with the diaphragm located above the bottle cap's top without causing the cap to be too tall. An ancillary benefit is that the bottle top may be sealed by a thin tamper indicating film or seal, in which the closure is screwed over the tamper seal. Hence the purchaser of that beverage is required to determine whether tampering has occurred by unscrewing the closure and breaking the seal prior to replacing the closure and consuming the bottles contents.

Reference is made to the prior Dark U.S. Pat. No. 4,440,327, granted Apr. 3, 1984, entitled "Fluid Dispensing Closure with integral Valve", the contents of which are incorporated herewithin in its entirety to describe the structure, geometry and formation of the basic closure, the mechanisms of operation, and the variety of shapes in which the invertible diaphragm for such closures may be formed as desired.

Reference is also made to the contents of the Komischke U.S. Pat. No. 4,860,934 granted Aug. 29, 1989 for a Closure for Receptacles, assigned to the Schmalbach-Lubeca AG company, including the drawings, which is incorporated herein in its entirety by reference to show the additional configurations of the closure of the kind described in my prior patent U.S. Pat. No. 4,440,327 and of the structure for incorporating side latches.

SUMMARY

The present invention provides a new diaphragm for closures. The invention improves upon the one piece molded closure presented in the Dark patent by modifying the shape of the diaphragm, achieving thereby, ease of operation in closures of small physical size. A secondary diaphragm may be said to be added between the spout and the invertible diaphragm in the prior closure design and the length and surface area of the latter is reduced. The resulting diaphragm is compound, effectively having two diaphragm sections, an upper elastically deformable, flexible, foldable section, as variously termed, and a lower section, which retains an invertible characteristic and the sections operate sequentially.

The foldable section is swiveled and pushed and is pulled by the pivoting spout, a "push pull" diaphragm operation that causes the foldable diaphragm section to wrap and unwrap, and the invertible diaphragm portion swivels and inverts. Being moved by the spout as the spout is manually swiveled to the closed position, the push pull diaphragm acts first to push, swivel, the invertible diaphragm over dead center, which thereby inverts, and then the foldable diaphragm is elastically deformed, contorted or wrapped about itself as it is pulled in a different direction by the spout, folding over upon itself during the movement, to a position underlying the spout as the spout pivots closed. The overall closure diaphragm is more compact in size than the prior design permitted and its sections are sequential in operation.

The present invention also encompasses an improved spout latch. That latch assembly includes a wall portion, dividing the upperside and underside spout surfaces. On one side the wall mounts the rigid latch member, the bar that is to engage the complementary latching rib on the spout, and, on the reverse side, the wall faces a cavity on the underside surface of the spout. The wall may be slightly flexed into such cavity, responsive to lateral force exerted by manually pushing the spout for the latching and unlatching operation. The preferred form of the present closure invention includes both the improved latch and the compound diaphragm.

A new method is also disclosed to fabricate the foregoing latch. The latched closure is formed with a mold consisting of two halves that define the closure between the two halves, defining the shape of the closure to be formed by the injection molding process. In respect of the latch, the first mold half that is located on the underside defines the one side of the wall supporting the latch member and the cavity adjacent that wall, and the second mold half on the other side defines the other side of the wall and the lateral protrusion or bar for the latch member, the latter as by an undercut or pocket in such mold half. In the process, following injection of the molten plastic into the mold cavity and prior to the injected plastic completely cooling, the first mold half is at least partially withdrawn to void the space beside the wall, evacuating the cavity. Then the second mold half is withdrawn. In withdrawing the second mold half, a force is exerted on the bar forcing it out of the mold's defining pocket to the side. The wall, which retains adequate flexibility at this stage, elastically yields into the adjacent cavity. The process thus avoids applying damaging forces to the formed latch bar by creating room to allow the latch bar to move out of the way of the mold half as the latter is withdrawn.

In view of the axially compressible seal carried by the spout in the prior design, an alternative closure presented herein is characterized by an elongate tubular member, the tubular wall being elastically compressible. The tubular member's walls are squeezed closed between the spout end and a sealing wall on the closure base.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

BRIEF DESCRIPTION OF THE DRAWINGS

In the Drawings:

FIG. 1 is a perspective view of a one piece closure according to the invention with the dispensing spout placed in the raised open position;

FIG. 2 is the same perspective view of the closure of FIG. 1 but with the spout placed in the lowered closed position;

FIGS. 3 and 4 illustrate the closure of FIG. 1 in top plan view and in bottom elevation view, respectively, with the spout positioned in the upright dispensing position;

FIG. 5 illustrates a bottom elevation view with the spout in the closed position;

FIG. 6 is a right side section view of the closure taken along the line 6—6 in FIG. 1;

FIG. 7 is the same right section view as FIG. 6, drawing to an enlarged scale, but illustrated with the spout in the closed position;

FIG. 8 is a perspective view of the spout and diaphragm portions of the closure of FIG. 1, drawn to an enlarged scale;

FIGS. 9A, 9B, 9C and 9D are pictorial section views of the spout, with the rear seal omitted, and diaphragm, illustrating the spout in open, two partially closed intermediate positions, and in closed position, respectively, and the elastic deformation that occurs in the diaphragm;

FIG. 10A is a front partial section view of the spout of FIG. 1, taken along the line 10—10 of FIG. 1 to better illustrate the latch members and FIG. 10B is the same front partial section view as in FIG. 10A to an enlarged scale but with the spout latched in the closed position, further illustrating the latch members;

FIGS. 11A and 11B illustrates the process for fabricating the novel closure and latch;

DETAILED DESCRIPTION

Figure 12:
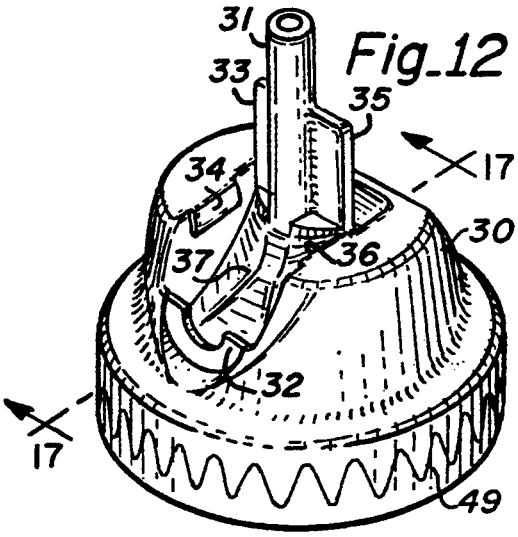
FIG. 12 is a perspective view of a one piece injection molded resealable drinking cup closure according to the invention with the dispensing spout in the upright dispensing position.

Referring to FIGS. 1 through 8, a plastic closure is shown, comprising a relatively rigid base 3 having a generally cylindrical side wall, a rigid outlet spout 5, which contains an outlet passage 9 and an extended cover surface 6, the latter being of wider dimension than the spout passage defining portion, a pivot line living hinge 7, and compound diaphragm 11, which is in two sections comprising of a foldable diaphragm 13 and invertible diaphragm 15.

As better shown in FIG. 6 the spout extends through the diaphragm and the entry to spout passage 9 is located on the underside of the formed closure for access to material to dispense. A seal 19 is formed on the bottom end of the spout, surrounding the entrance to spout passage 9. A wall which forms a seal surface 21, is formed in the closure base and in this embodiment descends from the top closure surface at a position immediately behind the pivot line 7. The arrangement is such that when the spout is pivoted to the closed position, as better shown in FIG. 7, seal 19 abuts seal surface 21 to provide a tight seal, suitably being compressed against that seal surface.

Seal 19 is preferably of an outwardly flaring geometry, resembling a suction cup and/or a Bellville spring that spreads out against the seal surface as it is compressed, the details of which are better illustrated and described in my prior patent U.S. Pat. No. 4,440,327, to which reference may be made as desired. Briefly the front end of spout 5 presses against the front wall of the closure base, at the reverse side of wall 4, creating an axial force pressing the spout and, hence, compressing the seal.

The front end of the spout preferably contains a bevel surface 8 for camming over the front latch member later herein described. Three stiffening brace sections 12, 14, and 16, illustrated in the bottom views of FIGS. 4 and 5, are formed between the sealing surface 21 and a depending wall of the closure to give the seal surface additional rigidity. The amount of stiffening braces used depends on the size of the closure.

With the spout in the closed position as in FIG. 2, the spout is received within a compartment 17 formed within base 3, recessed from the top surface 1 of the base. The cover portion 6 of the spout, suitably, fits flush with the bases' top surface 1. A recessed portion or indentation is formed in the cylindrical side wall of rigid base 5 to allow one to press a finger on the front edge of spout cover 6 in order to pivot the spout 5 to the dispensing position and provide better leverage to manually unlatch the spout from the front and side latches. Base 3 contains an internal thread 18 to permit attachment to a separate associated container, such as a bottle, partially illustrated in FIG.6.

Turning specifically to FIG. 8, which illustrates the diaphragm and spout section of the closure in perspective to an enlarged scale, the details of diaphragm 11 may be better understood. The bottom end or base of outlet spout 5 is attached to the foldable diaphragm 13 at an integrally formed bend line or flexible connection as variously termed, represented by dash line 28. Diaphragm 11 contains the invertible diaphragm section 15 and the foldable diaphragm section 13 in a mechanical series relationship. The two diaphragm sections are oriented relative to one another at a slight angle.

Foldable diaphragm section 13 is connected to the invertible diaphragm section 15 along a flexible connection 29 which forms a crease between those two diaphragm sections. The flexible connection 29 is formed on and may be defined as the locus of intersecting points between a plane that inclines downwardly through the pivot hinge 7 at a slight angle from the horizontal and intersects compound diaphragm 11, which is represented by the dash line 29A in FIG. 9A, later discussed. In this context flexible connection 29 is recognized also as a type of hinge, although not a living hinge as used in hinge 7 earlier described.

Foldable diaphragm section 13 is connected to the lower end of the spout through a flexible connection 28, represented in dash lines, and defines the top end of such diaphragm section and of the diaphragm overall. As shown, the diaphragm's top end at connection 28 extends horizontally across the base of the spout, from the right side of spout cover 6 to the left side thereof. The lower end of diaphragm section 13 is bordered by crease 29, which defines a curve. In this view section 13 in outline appears to resemble a human's lower lip. It may be noted that in this embodiment the surface area of diaphragm portion 13 is less than the surface area of invertible diaphragm portion 15.

In this embodiment, invertible diaphragm 15 is faceted in shape and has three essentially straight sides a, b and c, the former two being parallel and the latter perpendicular thereto, which forms a segment of a rectangle, through which sides the diaphragm is connected to the closure base as illustrated in the previous figures, including FIGS. 3, 4, and 5. That connection to the closure base holds the diaphragm as the diaphragm is flexed in the inversion process described. That peripheral border of the diaphragm thus may be regarded as a flexible connection or hinge, as variously termed. The top end of diaphragm 15 appears as a concavely arcuate shape, defined by crease 29, the border at which this diaphragm connects to foldable diaphragm 13, located immediately above.

While the peripheral edges of the diaphragm a, b and c attaching to the base in this embodiment are straight, it should be noted that in other practical embodiments the peripheral edge of that diaphragm may instead be one of many alternative geometries, as example, a continuous curve, such as a portion of a circle or ellipse, or edge c may be curved, such as circular, while retaining edges a and b straight.

During the pivoting movement of the outlet spout 5 about the pivot line hinge 7, as the spout is moved toward the closed position, the spout base forces the compound diaphragm to collapse inwardly in a sequential manner. First the invertible diaphragm 15 inverts, through the bisector plane 22 as represented in FIGS. 6 and 9*a*, and that is followed by the folding diaphragm 13 as the spout is further pushed to the closed position. Folding diaphragm 13 distorts when the invertible diaphragm 15 inverts so that there is very little restriction on its movement. Then the folding diaphragm moves in a wrapping and unwrapping movement as the spout is pivoted further to the closed position. The operation of compound diaphragm 11 and its sequencing in operation is discussed in greater detail hereafter in this specification. By contrast the diaphragm presented in Dark U.S. Pat. No. 4,440,327 flexed and closed in somewhat haphazard manner.

The dispensing closure is configured so that when the spout is in the dispensing position, it is perpendicular to the top of the closure; when the spout is vertical, the top of the closure is horizontal. When the spout is pivoted about the living hinge 7 at the back of the spout and placed in the closed position, the spout travels through an arc of ninety degrees and is re-oriented parallel to the top of the closure. In the latter position it is axis, like the closure top, is oriented horizontal.

To effect a positive pressure seal, both ends of the spout preferably abut against rigid base 3 when closing, as shown in FIG. 7. The cup seal 19 on the inside bottom surface of spout 5, surrounding the passage 9, through the spout, compresses and deforms when the dispensing end of outlet spout 5 engages the rigid base latch surface 10, the seal acting in the manner of a Bellville spring, thereby providing a firm seating against the inside seal surface 21 and positive sealing.

FIG. 9*a*, 9*b*, 9*c* and 9*d* pictorially depict with slight artistic exaggeration the diaphragm 11 in a closing sequence as spout 5 is pivoted from the vertical dispensing position, FIG. 9*a*, through to the closed sealing position in FIG. 9*d*. That sequence is reversed on opening. In these four illustrations the seal, located at the base of the spout, is omitted to more clearly illustrate the operation of the diaphragm. Sequential diaphragm 11 contains the invertible portion 15 and a folding portion 13, connected together at flexible connection 29.

FIG. 9*a* depicts the diaphragm in its molded position which is the dispensing position. In this position invertible diaphragm portion 15 is located above "bi-sector" plane 22. The bi-sector plane is defined as a plane that passes through living hinge 7 and the outer peripheral edges of diaphragm 15 that are attached to the closure base, here edges a, b and c which are flexural connections from the compound diaphragm to the rigid closure base. That bi-sector plane serves as a kind of "dead center" for the invertible diaphragm portion. Viewed three dimensionally, as illustrated earlier in FIG. 8, the diaphragm may be said to be convex in configuration at this position, bulging upwardly at least slightly above the bi-sector plane, and creates an upwardly directed force maintaining the spout upright; that is, the diaphragm resists the gravitational force attempting to topple the spout from the upright position.

The flexible connection or crease 29 connecting the two diaphragm sections, defined by the intersecting plane 29A as earlier described, moves as the spout is rotated closed. It may be recalled that intersecting plane 29*a*, viewed orthogonol to the plane of the paper in this view, traverses diaphragm 11 and passes through both ends of the living hinge 7. When the spout is in the open position, as in FIG. 9*a*, intersection plane 29A and crease 29 is positioned above bisector plane 22. In the sealed position as shown in FIG. 9*d*, intersecting plane 29A and the crease has pivoted through the bisector plane 22 to a position below the bisector plane.

As shown in FIG. 9*b*, when the spout is first moved, counterclockwise about hinge axis 7 in this illustration, the invertible portion of the diaphragm 15, inverts with the foldable diaphragm 13 distorting, which allows the invertible diaphragm 15 to invert or "pop" inside out easily. With pivoting movement of the spout to the closed position, both diaphragm sections are swiveled in position. As the spout is further pushed down as shown in FIG. 9*c* the foldable portion 13 continues to fold in a wrapping/unwrapping motion until it the diaphragm and spout is in the fully closed position as shown in FIG. 9*d*. The sequential flexing creates an easier operating diaphragm and, hence, a more versatile closure.

It may be noted that foldable diaphragm 13 extends in height up higher than the closure base's top surface 1, as viewed in the open position as shown in FIG. 9*a*, producing a recessed area 2 under the base of the spout. At the juncture between the bottom of the spout and diaphragm 13 there is another flexible connection 28. That connection and the recessed area allows the foldable diaphragm more room within which to fold.

Brief reference may be made to FIG. 4, which shows a bottom view of the compound diaphragm 11 with the spout upright, and to FIG. 5, which shows the same view with the spout in the closed position. By comparing the two figures one may ascertain the change in diaphragm shape on the bottom side resulting from flexing of the foldable diaphragm 13 and the inversion of the invertible diaphragm 15 in attaining the closed position in which seal 19, located at the rear of the spout, sealingly engages the sealing surface 21.

While the diaphragm in the foregoing embodiment is faceted in shape it should be recognized that the invertible diaphragm may be formed of many different shapes. It may be conical or dome shaped. It may be multifaceted in shape, such as a pyramid. Diaphragms of those shapes are capable of being turned inside out, inverted upon themselves.

The invertible diaphragm can be visualized as a segment of a hollow rubber ball. The inside surface is smaller in area than the area of the exterior surface. When that segment is inverted, that is, is turned inside out, the inside surface becomes the exterior surface and, hence, must stretch and the exterior surface becomes the interior surface and, hence, has to compress. That reversal of roles cannot be completely achieved due to physical limitations of the material. Therefore by extending the invertible diaphragm upward as earlier described, the diaphragm has more room in which to fold and thereby compensate for such physical limitations.

Likewise the foldable diaphragm portion may be of any selected shape so long as that section cooperates with the invertible diaphragm portion in the manner described herein. And the foldable diaphragm may be visualized as a thin flexible section that can be wrapped and un-wrapped about itself.

When the closure structure presented in Dark U.S. Pat. No. 4,440,327 is viewed in cross section through the center of the spout and diaphragm, one may view a triangle in which the bisector plane is the longest side or "hypotenuse" the rigid spout is on the "opposite side" and the invertible diaphragm is on the adjacent side. To attain an easily activated diaphragm, the angle between the "hypotenuse" and the "adjacent side" should be no larger than fifteen degrees. However large diameter rigid spouts requires that the leg on the opposite side of the "hypotenuse" to be greater in length in order to maintain such a fifteen degree limit. That increase in length, therefore, limits its application.

If, alternatively, a large diameter rigid spout was used with a short "hypotenuse" the "adjacent side" would also shorten and the angle between the "hypotenuse" and the "adjacent" side would increase and the effort to activate the diaphragm would also increase. The diaphragm, located on the adjacent side of the hypotenuse, would require a greater percentage of elastic distortion in the inversion process as the user manually pushes the spout with greater force to both open and close the spout.

In most applications the use of greater manual force was undesirable. By incorporating a hinge in the form of a crease through the smaller size diaphragm, the diaphragm was found to flex or fold more easily. Hence, with the improved diaphragm, closures can be produced in smaller sizes than before without the disadvantage of requiring additional manual effort to open and close the spout.

It may be noted that the degree of inversion in this embodiment and the associated forces produced thereby on the spout is less than that produced in a spout of corresponding size having the diaphragm structures disclosed in my prior patent, U.S. Pat. No. 4,440,327 for reasons earlier described. The downward force produced by the invertible diaphragm, after it is inverted as the spout is moved from the dispensing position toward the closed position, is less and the invertible diaphragm portion cannot itself produce the force to fold the foldable diaphragm portion. With the present improvement, thus, if the user stops pushing down on the spout at the position illustrated in FIG. 9*b*, the spout, will remain in the tilted off-vertical position, and does not fully close. That characteristic could be of benefit in a closure design in which the closure is intended to operate with the spout oriented at such an angle.

It should also be noted that all the drawings show the invention as it is molded and first activated. However, like all products that flex in operation, it is common to find that wrinkles are acquired or formed in the surface. Such wrinkles change the appearance of the diaphragm slightly, but do not affect the diaphragm's function.

To better illustrate the improved spout latch included in the disclosed embodiment, reference is made to the front section views of FIGS. 10A and 10B, which are sections of the closure taken along the lines 10—10 in FIG. 1 and 11—11 in FIG. 2, respectively. As shown in FIG. 10A, rigid spout 5, illustrated in the vertical dispensing position, includes two axially extending ribs 23 and 25 on the left and right hand side, respectively, integrally formed on the rigid spout 5 and symmetrically disposed thereabout. A first bar 24 is supported within the recess in the closure base by a supporting wall 20*a*, to the left and a second bar 26 is supported by a like supporting wall 20*b* to the right, with bars 24 and 26, suitably being symmetrically disposed in the recess.

Supporting walls 20*a* and 20*b* are joined with other wall members that are part of the recessed or compartment 17. The foregoing includes the wall that forms the bottom of the recess and connects to both walls 20*a* and 20*b*; the horizontally extending wall that extends from the top of wall 20*a* to the left in the figure; and the like horizontally extending wall that extends from the top of wall 20*b* laterally to the right in the figure. The side of wall 20*a*, opposed to the side containing the latch member, faces a cavity 24*a* in the underside of the closure base. Likewise the opposed side of wall 20*b* faces a like cavity 26*a*.

Those supporting walls have an appropriate elastic characteristic. By pushing on the latch member bar 24, laterally, to the left, the supporting wall 20*a* elastically yields slightly, moving into the adjacent cavity 24*a*, and then restores following removal of the pushing force. Likewise the same occurs by laterally pushing to the right on latch member bar 26 which moves into cavity 26*a*. The bars are positioned within the path of travel of ribs 23 and 25 as the spout is manually moved from the vertical position shown. The ribs encounter and abut against the bars, applying force laterally to the bars moving them apart, as the spout is manually pushed and latched into the closed position as illustrated in FIG. 10B to which reference is made.

With the spout in the closed position supporting walls 20*a* and 20*b* have restored to the normal position and latched bars 24 and 26 are placed in position overlying ribs 23 and 25, respectively, in latching engagement serving as an obstruction to raising the spout. The shape of the latch bars and corresponding ribs on the spout are such as to provide a camming action on the bars as the spout is lowered into closed position so as to ease the movement into latched position and a descending action when the spout is in the closed position so as to require a greater pushing force on the spout to unlatch it. Minimally the strength of the latch is greater than the force exerted by compression on the spout's rear seal and by the bend in the elastic deformable diaphragm that occurs at the foot of the spout so that the spout remains closed. Ideally the latch is also strong enough to withstand such additional pressures as might be expected if the container were to be squeezed.

Referring to FIG. 11A, the closure member is adapted to be injection molded in the dispensing position and moved to the sealed position during the molding cycle. The molding cycle includes the mold closing surface known as a parting line 93 of cavity 90 contacting a stripper plate having a surface 92 and an ejector half surface 94 which contacts an ejector surface 95 creating another parting line. In this position hot molten plastic is injected into cavity 89 to form, upon cooling, a one piece molded closure of plastic material.

In this mold configuration parting line 92-93 is opened first with the molded closure attached to the cores 86 and 96. After the ejector half of the mold has opened sufficiently for the molded closure to be freed of the cavity 89 plates 87*a*, 87*b*, 87*c* stop traveling and plates 84 and 85 continue to move retracting core 96 from the inside of the closure so that the spout and diaphragm are hollow and can be flexed closed by a bar 88 which traverses across the face of the mold to close the spout. After bar 88 returns to its home position, plate 87*a* moves forward stripping the closure off of core 86.

The foregoing molding sequence, wherein parting line 92-93 opened first and parting line 94-95 opened secondly, was earlier described in the Dark patent. That process may be used in those embodiments of the invention that do not incorporate the novel latch structure earlier described. However for the illustrated embodiments containing the novel latch, the following process is employed.

FIG. 11B depicts a similar mold design that activates in a difference sequence. Hot molten plastic is injected into the cavity and allowed to cool to about 120 degrees Centigrade forming the closure. The first parting line to open is 94-95; the second parting line to open is 92-93. This molding sequence allows the latch protrusion 24 and 26, better illustrated in FIG. 10A, to be molded without the protrusions being damaged as the mold opens. Latch protrusions 24 and 26 are formed in recessed areas of the cavity forming an undercut. To remove this portion of the closure from the cavity the closures upstanding walls 20*a* and 20*b*, FIG. 10A, are required to flex to allow both latch protrusions 24 and 26 to release from the cavity undercut in which they were formed. For the upstanding walls to so flex requires the appearance of hollow areas 24*b* and 26*b* behind that wall. These hollow areas are formed by cores 24*c* and 26*c* which are part of the spout core 96. In this molding sequence parting line 94-95 opens first, retracting the spout core 96 and cores 24*c* and 26*c*, thereby creating hollow areas 24*b* and 26*b*. Then parting line 92-93 opens retracting the closure from the cavity. During the opening of parting line 92-93, the upstanding support walls of the closure, not numbered in this figure but identified as 20*a* and 20*d* in FIG. 10A, flex, allowing the latch protrusions 24 and 26 to be removed from the cavity undercuts, 24*u* and 26*u* in which the protrusions were formed in the injection molding process. The formed closure, though cooled from the molten state, remains quite hot, a high enough temperature to allow the described side wall flexing. After the closure is removed from the mold, the closure eventually cools down to room temperature.

As those skilled in the art the invention may be molded from any of a variety of known plastic materials and as new plastic materials are developed in the future such new materials may also be used for the disclosed closures. While some injection molding plastic materials have the appropriate flexural characteristics, some such materials may not be suitable for a specific application to which a particular closure is intended. Some plastic materials are affected by soaps, detergents and other chemicals and, hence, those should not be selected for use in closures intended for use with those chemicals. Many materials simply have not been approved by government agencies responsible for food, beverage and drug applications and cannot be used without such approval. Other plastic materials are simply too expensive. As those skilled in the art appreciate the latter considerations are known and they are recognized as being extraneous to the invention and its mode of operation. Hence, although deserving brief note, those selection criteria need not be further discussed.

The plastic material preferred is a co-polymer polypropelene, more specifically a rubber modified copolymer. Polypropylene is a member of the Polyolefin family, many of which can be used for the disclosed closures. The properties of polypropylene are such that thick sections are relatively rigid, thinner sections are flexible and very thin sections can be used as living hinges. Living hinges are flexed during or immediately after being molded. The flexing orients the molecules in the material and, as a consequence, the living hinge will be able to function continuously.

The foregoing closure invention may be applied to dispensing of any flowable materials ordinarily dispensed by closures in general, whether fluid, granular material or the like, and any dispensing applications that may in the future be conceived. Lotions, conditions, detergents, soaps, toothpaste, honey, salt, pepper and other seasonings, beverages, even small pills are some examples of the materials that may be dispensed.

Reference is now made to FIGS. 12 through 19 illustrating in various views a bottle cap closure according to the inventions intended for drinking cup applications, a "sport bottle". As becomes apparent the form of closure contains all essential elements of the closure previously described, with slight exception and differs in size. As shown in FIG. 12 the pivotable rigid spout 31, cylindrical in shape, is in the dispensing position, upstanding, on closure base 30, extending up from a recess in that base. Side latch members 33 and 35 are symmetrically positioned on and carried on the right and left hand side of the spout and are essentially rigid. Those side latch members engage and latch with the corresponding latch members 34 and 36, carried upon the flexible side walls of the base within the recess, when the spout is pivoted into its closed position as illustrated in the perspective view of FIG. 13 and in FIGS. 18 and 19. The side latches firmly latch the spout in the closed position and may be released by the user applying sufficient upward force upon the end of the spout.

Compound diaphragm 37 is connected to the bottom front end of the spout, to the side walls and in the front end to seal the closure while allowing pivoting movement of spout 31. A stop 32 provides a semi-circular seat to receive the front end of the spout when the spout is latched in the closed position.

Figure 15:
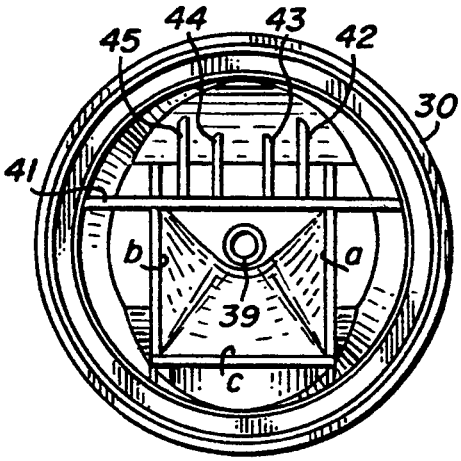
Figure 16:
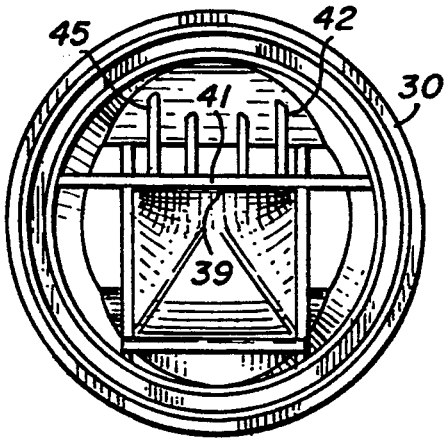
FIG. 16 illustrates the closure of FIG. 12 in bottom elevation view with the spout closed.
Figure 18:
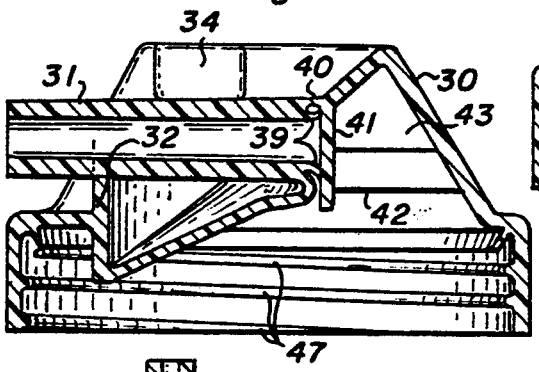
FIG. 18 is the same right side section view as FIG. 16 to an enlarged scale and with the spout in the closed position.
Figure 19:
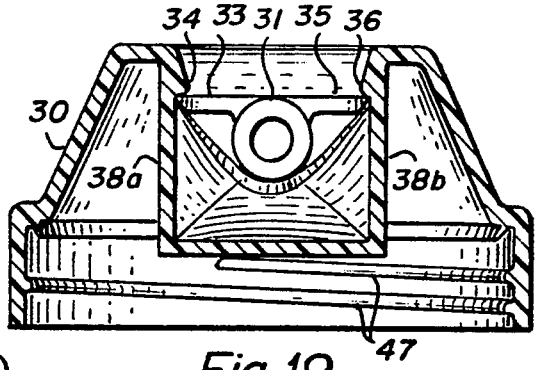
FIG. 19 is a front partial section view of the spout of FIG. 12, taken along the lines 21—21.

As illustrated in the bottom elevation view of FIG. 15, with the spout in the dispensing position, the spout's rear end opens the fluid passage to the underside of the closure. That opening is surrounded by seal 39. When the spout is moved to the closed position, seal 39 compresses against the sealing surface or wall 41, a relatively rigid surface that depends from the top surface of the essentially rigid closure base as illustrated in FIGS. 16 and 18. A number of braces 42, 43, 44 and 45 extend from the side wall and brace sealing surface 41 to ensure that the sealing surface rigidly maintains its position against the compressive force exerted by the compressed seal.

Figure 13:
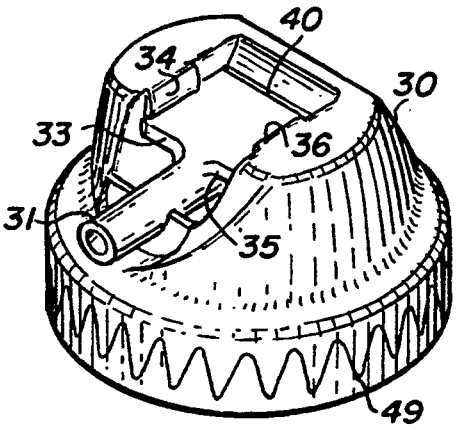
FIG. 13 is the same perspective view of the closure of FIG. 12, but with the spout placed in the horizontal closed position.

The inner bottom surface of the closure contains a thread 47 to permit the closure to be fastened to a suitable bottle, not illustrated, containing a corresponding screw thread. A knurl 49 is formed on the outer lower edge of the closure, as illustrated in FIG. 13, to aid the use to more easily turn the closure to attach same in place on the bottle or to detach the closure therefrom.

Figure 14:
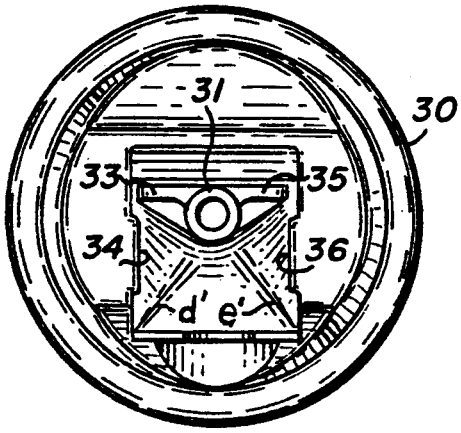
FIGS. 14 and 15 show the closure of FIG. 12 in top plan view and in bottom elevation view, respectively.
Figure 17:
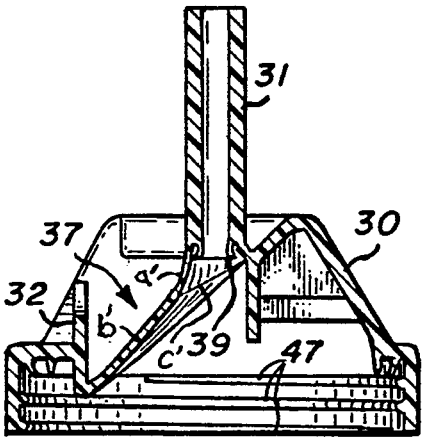
FIG. 17 is a right side section view of the drinking cup closure taken along the lines 17—17 in FIG. 12.

Diaphragm 37, as shown in FIGS. 12, 14, and 17 is formed of, and contains a flexible foldable diaphragm a' and an invertible diaphragm b' (FIG. 17), in that order connected between the spout at the upper end and the closure base at the lower front bottom end, with the two diaphragm sections separated by a bend or crease c'. For added flexibility the invertible diaphragm includes two crease lines d' and e', dividing the diaphragm into three sections. Crease line d' extends from the lower left corner of the diaphragm at the angle to the top midpoint. Crease e' extends from the lower right corner to that same midpoint. The foregoing is the same essential arrangement and has the same mode of operation described for the earlier embodiment, which, therefore, need not be repeated.

Each of the walls supporting the latch member 34 and 36 on one side facing the recess in the closure have an opposed wall surface that faces a void or cavity formed in the underside of the closure. Since the wall has some flexibility, and elastically yields as the corresponding latch members carried by the spout apply lateral force on the member when the spout is moved to the closed position and, conversely, when the spout is raised from the latched position. More importantly, in forming the latch during the injection molding process the mold requires sequentially activated parting lines as previously described in FIG. 11B, the tool defining the bottom side of the closure member is first withdrawn to evacuate the cavity adjacent the latch containing side walls. This allows the other tool that defines the closures upper surface to be withdrawn and in so doing force the latch members laterally, flexing the side wall. The latch member thus has some place to move to, out of the way, while the tool is being withdrawn, avoiding damage to the latch member as could otherwise occur when the tool is withdrawn. The foregoing is the same technique and function as for the earlier described closure.

Figure 20:
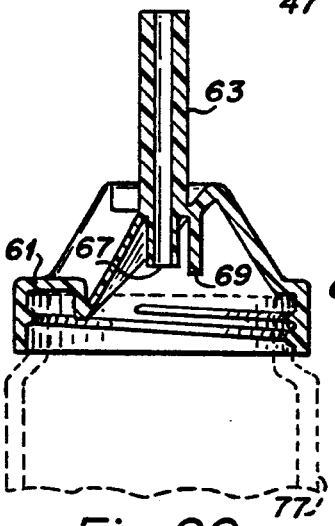
FIG. 20 is a simplified pictorial side section view of an alternative embodiment of a one piece closure, which employs a cylindrical "straw like" collapsible wall seal, illustrated with the spout in the open condition.
Figure 21:
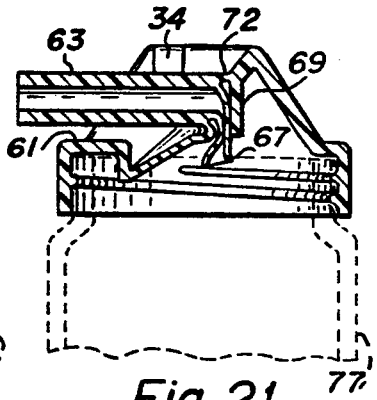
FIG. 21 is the same section view as FIG. 20 with but with the spout shown in the lowered closed position.

Reference is made to FIGS. 20 and 21, which illustrate another form of drinking closure in partial section view in the dispensing and closed spout positions respectively. The closure is formed in one piece by injection molded plastic material and includes a rigid base 61 a pivotable rigid spout 63, diaphragm 65, seal 67, located at the foot portion of the spout, seal surface 69, comprising a rigid flat wall depending from a top surface of the base. Seal surface 69 may be braced to obtain additional rigidity by additional wall sections extending from the rear of the seal surface to the tapered upper wall of the closure, not illustrated in these figures, disclosed in FIGS. 15 and 18.

The closure preferably includes side latches of the type described in connection with the preceding embodiment, which is not illustrated in these figures. The closure is fastened to a bottle by a thread 64, formed on the inner cylindrical surface of the lower portion of the closure base, which engages corresponding screw threads on the bottle.

Diaphragm 65 is of the compound diaphragm type with both a flexible foldable section and an invertible section as earlier described in detail in connection with the preceding closure embodiments or, alternatively, is of the invertible diaphragm type disclosed in Dark U.S. Pat. No. 4,440,327.

Seal 67 is formed by a thin wall elongate cylindrical member formed on the foot end of spout 63 as a reduced thickness portion and is coaxial therewith. Suitably the seal is of a wall thickness that allows the wall to be easily compressed together, much like a plastic drinking straw, when the spout is swiveled to its closed latched position as illustrated in FIG. 21. By kinking and squeezing the straw" section, the spout passage is blocked. The foregoing seal provides an alternative to the seal used in the preceding embodiments.

The length of the elongate cylindrical seal can be short as illustrated or, alternatively, be of such a length as to protrude deep into the portion normally occupied by the beverage. In the latter arrangement the spout and seal would serve also the function of a drinking straw, permitting the user to suck the confined beverage.

The closure is formed by injection molding and in use it is operated by the user essentially the same as the preceding sport cap closure embodiment, excepting the seal as hereinbefore described and for the alternative of sipping.

Figure 22:
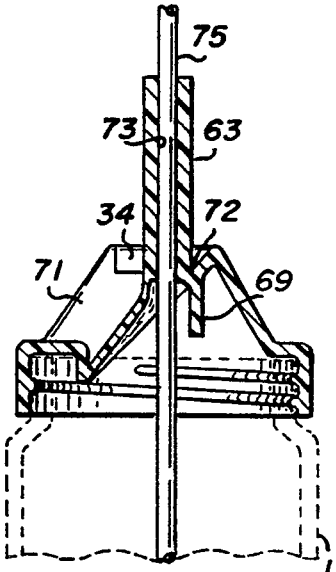
FIG. 22 is a simplified pictorial side section view of a two piece straw tube version of the closure of FIG. 20 with the spout in the open position and FIG. 23 is the same section view with the spout shown in the closed position.
Figure 23:
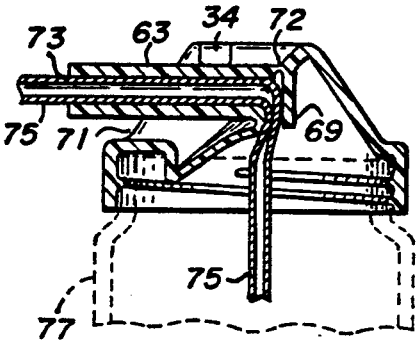

A still further alternative for a sport cap closure, though less preferred, is fabricated as a one piece cap 71, of the geometry of the closure described in connection with the embodiment of FIGS. 22 and 23, without a cylindrical shaped seal formed on the bottom or foot end of the spout 73, which is illustrated in the partial section of FIG. 22. Instead, a drinking straw 75, which may be separately purchased or supplied by the user, is inserted through the spout passage to complete the combination, the passage of an appropriate diameter to allow the straw to easily be inserted. When the spout is latched in the closed position, as shown in FIG. 23, the foot end of the spout compresses or collapses the underlying portion of the plastic drinking straw. Although the closure base is formed as a one piece member by the injection molding technique, the foregoing closure is a two piece closure.

As previously stated the diaphragm flexes and distorts during its use which causes wrinkles and slight distortions in the appearance of the diaphragm. This does not interfere with its function. However, after use it does appear slightly different than it appears when it is newly molded and as shown in these drawings.

Figure 24:
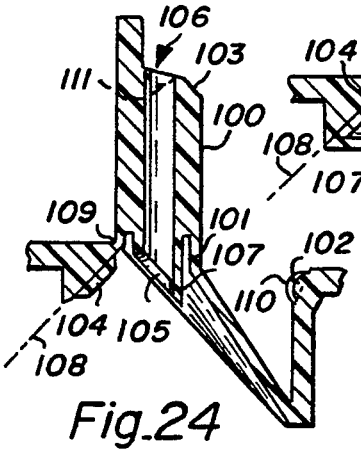
FIG. 24 is a partial section view of still another closure embodiment which contains a novel double seal in which the closure spout is shown in the dispensing position.
Figure 25:
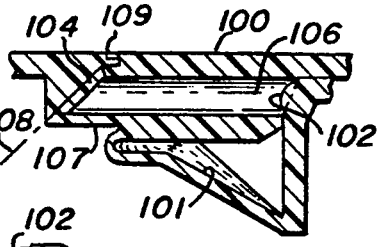
FIG. 25 is the same partial section view as in FIG. 24, with the spout shown in the closed position.

FIGS. 24 and 25 depict another embodiment of the inventions in partial section view in which a double seal of a different structure is used. As an additional feature the embodiment also contains a novel camming structure at the front end of the spout to avoid wear on the front seal. FIG. 24 depicts the spout in the dispensing position and FIG. 25 depicts the same elements in the closed sealed position. These figures show the spout, diaphragm, and a portion of the closure base. Other portions of the closure, such as earlier presented in the preceeding embodiments, are omitted for clarity and ease of understanding of the new seal. However, it is understood that the rear seal arrangement described in FIGS. 24 and 25 is preferably employed within a one piece injection molded closure of the preceeding embodiments as an alternative to the seals earlier illustrated and may be used in such embodiments separately and/or together with the novel camming arrangement hereafter described.

The spout 100 and diaphragm 101 cooperate with the pivot line living hinge 109 to invert from a open position to a closed position in the same manner as has been described previously. The dispensing passage 106 passes through the spout and extends down below the top of the closure in a tubular portion 107. The end of the tubular portion is oriented at an angle to the top of the closure, the latter of which is illustrated as horizontal.

The seal wall 108 is oriented at an angle of 90 degrees relative to the end of the tubular portion so that when the spout is moved, through an angle of ninety degrees, to the closed position, the tubular portion 107 abuts against the seal wall 108. A plug 104 is located on seal wall 108. Plug 104 fits tightly into the sealed surface 105, which is positioned on the bottom inside surface of the dispensing passage 106 and suitably sized and shaped, configured, to tightly fit over the plug.

The side walls of plug 104 are tapered. As illustrated in the cross section view the tapered side wall of the plug at the upper edge appears vertical, parallel to the axis of the spout. Hence there are not undercuts or overhanging portions to the plug, which permits the molding tool used in forming the closure to be easily removed after formation of the closure without damaging the plug.

The novel camming structure for the spout is next considered. Front plug 102 is positioned on an upstanding wall and aligns with the outlet portion of the spout's dispensing passage 106, when the spout is in the closed position. Cam 110 is located on the upstanding wall adjacent front plug 102 and protrudes, laterally into the recess area, to a greater length, than the front plug. When spout 100 is pivoted to the closed position, ramp surface 103 engages and rides up and over cam 110 without contacting front plug 102. After the ramp passes over cam 110, the cam enters into a cam recess 111, indicated in dash lines, that is located in the spout side, adjacent spout passage 106.

The cam recess may be a pocket like opening formed in the spout wall accessible only from the front or may be an indentation in the side wall that extends through the front of the spout. Once the cam has entered recess 111, front plug 102 may enter and seal dispensing passage 106 from the front end of the spout. As a consequence, the front plug will not become worn as would occur in a less preferred embodiment in which the ramp surface was to ride over the plug each time the dispensing system is used.

The length of the spout and tubular portion 107 may be slightly longer than the distance between plug 104 and front plug 102 to increase compressive force on the spout so that in the sealed position the spout is held firmly in place.

In other embodiments of the foregoing closure, in which wearing down of front plug 102 is not a serious concern, cam recess 111 and cam 110 may be deleted. When the spout is moved to the closed position in such alternative embodiment, ramp surface 103 at the front lower edge of the spout, rides up and over the front plug 102 allowing the plug 102 to enter into the dispensing passage 106. As those skilled in the art appreciate, although the foregoing rear seal and front camming structures have been described in connection with a one piece unitary dispensing closure those structures may also be incorporated in other closures as well, those formed of multiple pieces, even though of less benefit therein.

The form of rear seal formed by elements 104 and 105 shown in FIG. 24 and 25 may also be used with the side latch structure discussed earlier in connected with the other disclosed closures, such as the "sport cap" wherein, there is no front plug. When used without a front plug the pivot line hinge 109 should be of sufficient strength and thickness to hold the spout firmly against the plug 104.

It is believed that the foregoing description of the preferred embodiments of the invention is sufficient in detail to enable one skilled in the art to make and use the invention. However, it is expressly understood that the details of the elements which are presented for the foregoing enabling purpose are not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. In a one piece molded plastic resealable dispensing closure of the type comprising:

a closure base defining a seal surface;

a dispensing spout defining a passage through said base, with said spout being swivelly mounted by a pivot axis to said base for positioning in a dispensing position and, alternatively, in a sealing position;

an invertible flexible diaphragm, said diaphragm having a peripheral portion connected to said base and means connecting another peripheral portion of said invertible diaphragm to said spout, with a portion of said peripheral portion located most distant from said pivot axis and said pivot axis defining a plane, whereby movement of said spout swivels said invertible diaphragm through said plane, responsive to which said invertible diaphragm inverts;

said diaphragm providing an arrangement that preloads said spout in the direction of the dispensing position, when said spout is in the dispensing position, and pre-loads said spout in the direction of the sealing position, when said spout is in the sealing position;

the improvement wherein said means connecting said spout to said invertible diaphragm comprises:

a elastic foldable diaphragm means for coupling a force applied to pivot said spout to said invertible diaphragm during movement of said spout to swivel and permit inverting of said invertible diaphragm as said spout is moved to the sealing position, said foldable diaphragm being sufficiently pliant to be pulled by said spout and placed in a position underlying said spout with a bend formed at the juncture of said foldable diaphragm with said spout, when said spout is in said sealing position, said spout initially folding over a portion of said foldable diaphragm in overlying relationship with a remaining portion of said foldable diaphragm to create a bend in said foldable diaphragm, responsive to said spout being moved from said dispensing position toward said sealing position, and then unfolds said diaphragm, responsive to said spout being moved further to said sealing position, whereby the location of said bend moves along said foldable diaphragm to said juncture of said foldable diaphragm with said spout; wherein said foldable diaphragm reduces said pre-load on said spout in the direction of said dispensing position responsive to folding over; and wherein said invertible and foldable diaphragms collectively define a predetermined surface area when said spout is in said dispensing position with each said diaphragm covering a more than insignificant portion of said surface area.

2. The invention as defined in claim 1 wherein said foldable diaphragm comprises a first predetermined surface area and said invertible diaphragm comprises a second predetermined surface area, said first predetermined surface area being less than said second predetermined surface area; and a crease at the boundary between said foldable diaphragm and said invertible diaphragm to permit at least some pivotal movement between said foldable diaphragm and said invertible diaphragm, responsive to said spout moving from said dispensing position.

3. The invention as defined in claim 2 wherein said foldable diaphragm is of a predetermined length which extends in the direction of the spout axis a predetermined distance beyond the bottom of said spout, responsive to said spout being in said dispensing position.

4. The invention as defined in claim 1 wherein said invertible diaphragm includes two straight lateral side ends oriented parallel to one another, a straight bottom end oriented perpendicular to said two lateral side ends and an upper end, bordering said deformable diaphragm, having a concavely curved shape.

5. The invention as defined in claim 3 wherein said invertible diaphragm includes two straight lateral side ends oriented parallel to one another, a straight bottom end oriented perpendicular to said two lateral side ends and an upper end, bordering said deformable diaphragm, having an arcuate shape.

6. The invention as defined in claim 1 wherein said closure base includes an upper side surface and an underside surface with said dispensing spout defining the fluid passage between said upper and underside surfaces; and further includes: latch means on said base for releasably latching said spout in the sealing position, said latch means including a first latching member located to one side of said spout for engagement with a complementary latching member located on said spout responsive to said spout being in the sealing position; and further comprising:

a wall on said base for supporting said first latching member with one side of said wall being on the upper side surface and the opposed side of said wall being on the underside surface in spaced relation with other portions of said base to define a cavity behind said opposed side of said wall, said wall being sufficiently flexible to permit said spout to move into the sealed position and be latched responsive to application of a sufficient force applied to said spout.

7. The invention as defined in claim 5 wherein said closure base includes an upper side surface and an underside surface with said dispensing spout defining the fluid passage between said upper and underside surfaces and further includes latch means on said base for releasably latching said spout in the sealing position, said latch means including a first latching member located to one side of said spout for engagement with a complementary latching member located on said spout responsive to said spout being in the sealing position; and further comprising:

a wall on said base for supporting said first latching member with one side of said wall being on the upper side surface and the opposed side of said wall being on the underside surface in spaced relation with other portions of said base to define a cavity behind said opposed side of said wall, said wall being sufficiently flexible to permit said spout to move into the sealed position and be latched responsive to application of a sufficient force applied to said spout.

8. In a one piece resealable closure of plastic material of the type containing a pivotable spout and a diaphragm moved by said spout mounted on a closure base in which said spout is swivelly mounted to said base for movement about a pivot axis between a dispensing position and a closed position and said diaphragm is swivelly mounted to said base for swiveling movement by said spout, said diaphragm having an edge most distant from said pivot axis, said distant edge defining with said pivot axis a plane; said spout having a foot end containing a seal for sealing engagement with a sealing surface of said closure base responsive to said spout being swiveled about said pivot axis into said closed position, the improvement wherein said diaphragm comprises a flexible compound diaphragm of predetermined surface area, said compound diaphragm including a flexible foldable diaphragm and an invertible diaphragm serially connected in the order recited between said spout foot end and said closure base with each said flexible foldable diaphragm and invertible diaphragm comprising a more than insignificant portion of said predetermined surface area; and said invertible diaphragm inverting responsive to being swiveled through said plane, and wherein a portion of said foldable diaphragm is folded over in overlying relationship with a remaining portion thereof to create a bend in said foldable diaphragm, responsive to said spout being pivoted from said dispensing position toward said closed position, and then unfolds, responsive to said spout being pivoted further to said closed position, wherein said bend moves along said flexible foldable diaphragm to said juncture of said flexible foldable diaphragm with said foot end of said spout.

9. The invention as defined in claim 8 wherein said flexible foldable diaphragm and said invertible diaphragm are angularly inclined relative to one another, when said spout is in the dispensing position, to define a crease therebetween.

10. The invention as defined in claim 9 wherein said flexible foldable diaphragm includes a top end connected to said foot end of said spout and defines a bend line therewith at that end, said flexible foldable diaphragm being bendable relative to said spout at said connection with said spout foot end.

11. The invention as defined in claim 10, wherein said foot end of said spout moves in an arcuate path to push said flexible foldable diaphragm during the initial course of travel of said spout to the closed position and through said flexible foldable diaphragm to invert said invertible diaphragm and during additional movement to the sealing position to place said flexible foldable diaphragm in a position underlying said spout;

said flexible foldable diaphragm being adapted to swivel about and be pushed and then pulled by said arcuately moving foot end of said spout, whereby said flexible foldable diaphragm is temporarily flexed and forms a bend therein that moves to said foot end of said spout and is placed in a position underlying said spout, responsive to said spout attaining the closed position.

12. The invention as defined in claim 11, further comprising: latch means for releasibly latching said spout in the closed position.

13. The invention as defined in claim 10 wherein said flexible foldable diaphragm comprises a predetermined surface area that is less than the surface area of said invertible diaphragm and defines a crease at the boundary thereof with said invertible diaphragm to permit pivotal movement between said flexible foldable diaphragm and said invertible diaphragm.

14. The invention as defined in claim 13, wherein said flexible foldable diaphragm is of a predetermined length which extends a predetermined axial distance beneath said foot end of said spout, responsive to said spout being in said dispensing position.

15. The invention as defined in claim 10, wherein said invertible diaphragm includes two straight lateral side ends oriented parallel to one another, a straight bottom end oriented perpendicular to said two lateral side ends and an upper end, bordering said flexible foldable diaphragm, having a concavely curved shape.

16. A one piece resealable closure of plastic material, comprising: a pivotable spout and a diaphragm mounted on a closure base with said spout being swivelly mounted to said base for movement about a pivot axis between a dispensing position and a closed position and said diaphragm being swivelly mounted to said base for swiveling movement by said spout; said diaphragm defining a surface area and having an edge most distant from said pivot axis, said most distant edge and said pivot axis defining a plane; said spout having a base containing a seal for sealing engagement with a sealing surface of said closure base, responsive to said spout being swiveled into the closed position; latch means for releasibly latching said spout in the closed position; and wherein said diaphragm comprises:

a flexible diaphragm and an invertible diaphragm serially connected between said spout base and said closure base, with each comprising a more than insignificant portion of said surface area;

said invertible diaphragm inverting responsive to being swiveled through said plane and providing an arrangement that pre-loads said spout in the direction of the dispensing position, when said spout is in the dispensing position, and pre-loads said spout in the direction of the sealing position, when said spout is in the sealing position;

said flexible diaphragm and said invertible diaphragm being angularly inclined relative to one another, when said spout is in the dispensing position, to define a crease therebetween;

said flexible diaphragm including an upper end connected to said spout base and defining a bend line therewith at said upper end, wherein said flexible diaphragm is bendable relative to said spout at said connection with said spout base;

said base of said spout being movable in an arcuate path to push said flexible diaphragm during the initial course of travel of said spout from said dispensing position to the closed position and, through said flexible diaphragm, to invert said invertible diaphragm and, during additional movement to the closed position, to place said flexible diaphragm in a position underlying said spout; and said flexible diaphragm being adapted to swivel about and be pushed and then be pulled by said arcuately moving base of said spout, whereby said flexible diaphragm is temporarily deformed and forms a bend therein that moves toward said spout base, responsive to said spout moving from said dispensing position toward said closed position, and is placed in a position underlying said spout responsive to said spout attaining the closed position.

17. The invention as defined in claim 16 wherein said closure base includes a compartment recessed from a top surface thereof; wherein said diaphragm is located within said compartment and wherein said spout is swivelable into said compartment to attain said closed position and orient a surface of said spout flush with said top surface of said closure base.

18. The invention as defined in claim 16, wherein said invertible diaphragm includes two straight lateral side ends oriented parallel to one another, a straight bottom end oriented perpendicular to said two lateral side ends and an upper end, bordering said flexible diaphragm, defining a curve in shape.

19. The invention as defined in claim 18 wherein said latch means comprises:

a first latching member located to one side of said spout for engagement with a complementary latching member located on said spout responsive to said spout being in the sealing position;

a wall on said base for supporting said first latching member with one side of said wall being on an upper side surface of said closure base and the opposed side of said wall being on an underside surface of said closure base in spaced relation with other portions of said closure base to define a cavity behind said opposed side of said wall, said wall being sufficiently flexible to permit said spout to move into the sealed position and be latched responsive to application of a sufficient force applied to said spout to move said spout to said sealed position and to permit said spout unlatch and move toward said dispensing position responsive to application of a sufficient force applied to said spout to move said spout to said dispensing position.

20. In a one piece injection molded plastic closure of the type containing a movable spout that is pivotable about a pivot axis between a dispensing position and a sealed position and a diaphragm of predetermined surface area moved by said spout during pivoting of said spout, with said diaphragm having an edge most distant from said pivot axis, said edge and said pivot axis defining a plane, the improvement wherein said diaphragm comprises a sequential diaphragm, said sequential diaphragm containing a plurality of diaphragm sections with said sections being operated in sequence by said spout as said spout moves between said dispensing and sealed positions with one of said plurality of diaphragm sections being an invertible diaphragm operable to invert responsive to being moved through said plane and another of said plurality of diaphragm sections being a flexible diaphragm operable to wrap over upon itself and each diaphragm section comprising a more than insignificant portion of said predetermined surface area.

21. A diaphragm formed of plastic material for connecting a pivotably mounted member to a base, said diaphragm defining a predetermined surface area, comprising:

a first diaphragm section defining a flexible diaphragm; and a second diaphragm section defining an invertible diaphragm;

said first and second diaphragm sections each comprising a greater than insignificant portion of said predetermined surface area;

said second diaphragm section being connected integrally to said first diaphragm section for placing said two sections in a mechanical series relationship, wherein movement of said first diaphragm section forces movement of said second diaphragm section;

said second diaphragm section having a peripheral portion for connection to said base and having the characteristic of elastically inverting when pushed with suitable force by said first diaphragm section when said peripherial portion is held in fixed position; and said first diaphragm section having a peripheral portion for connection to said pivotably mounted member and having the characteristic of flexurally wrapping over responsive to the application of sufficient torque to said peripheral portion by said pivotal member.

22. The diaphragm as defined in claim 21 wherein said connection between said first and second sections defines a crease.

23. The invention as defined in claim 21 wherein said first and second diaphragm sections are formed with the respective surfaces thereof angularly inclined relative to one another define a crease at the connection between said sections.

24. In a one piece resealable closure formed of injection molded plastic material of the type containing a pivotable spout and a diaphragm mounted on a closure base, wherein said spout is swivelly mounted to said base for movement between an upright dispensing position and a closed sealing position and said diaphragm is swively mounted to said base for movement by said spout, said closure base having an upperside surface and an underside surface with said spout providing a passage for flowable material from said underside surface of said closure base to said upperside surface thereof, and latch means for releasibly holding said spout in said closed position, said latch means further comprising a spout bar projection formed on each of the right and left hand sides of said spout laterally outwardly projecting therefrom and a corresponding base bar projection located on each of the right and left hand sides of said closure base and base bar mounting means for mounting said base bar projection to overlie and latchingly engage the corresponding spout bar projection when said spout is in the closed position; the improvement therein wherein said base bar mounting means for mounting said base bar projections comprises:

a first support wall on said base located to the left hand side of said spout for supporting one said base bar projection with one side of said wall being on the upper side surface of said base and the opposed side of said wall being on the underside surface of said base in spaced relation with other portions of said base to define a cavity behind said opposed side of said wall;

a second support wall on said base located to the right hand side of said spout for supporting the other base bar projection with one side of said wall being on the upper side surface of said base and the opposed side of said wall being on the underside surface of said base in spaced relation with other portions of said base to define a cavity behind said opposed side of said wall, said walls being sufficiently flexible laterally into the respective cavity to permit said spout to move into the sealed position and be latched, responsive to application of a sufficient force applied to said spout, and to permit release of said latch responsive to application of a sufficient force, greater than the closing force, to said spout to move said spout from the closed position toward the dispensing position.

25. The invention as defined in claim 24 further comprising: first and second lateral extending walls in said base, each having one wall surface on the upper side of said closure and an opposed surface on the under side surface of said closure;

said first lateral extending wall connected between an upper end of said first support wall and another portion of said closure base for bracing said support wall and said opposed surface thereof defining a border to said cavity behind said first support wall; and said second lateral extending wall connected between an upper end of said second support wall and another portion of said closure base for bracing said support wall and said opposed surface thereof defining a border to said cavity behind said second support wall.

26. The invention as defined in claim 25 wherein each of said first and second lateral extending walls is of a relatively rigid characteristic.

27. The invention as defined in claim 25 wherein said diaphragm comprises a flexible compound diaphragm, said flexible compound diaphragm including a flexible foldable diaphragm and an invertible diaphragm serially connected in the order recited between a base end of said spout and said closure base.

* * * * *